US005350006A

United States Patent [19]

Hanano

[11] Patent Number: 5,350,006

[45] Date of Patent: Sep. 27, 1994

[54] DEVICE FOR SPRAYING MOLD RELEASE AGENT AND FEEDING MOLTEN METAL

[75] Inventor: Takashi Hanano, Kobe, Japan

[73] Assignee: Hanano Corporation, Hyogo, Japan

[21] Appl. No.: 87,318

[22] Filed: Jul. 8, 1993

[30] Foreign Application Priority Data

Sep. 14, 1992 [JP] Japan ..... 4-244988

[51] Int. Cl.[5] ..... B22D 17/20

[52] U.S. Cl. ..... 164/267; 164/312

[58] Field of Search ..... 164/267, 312, 149, 72, 164/74, 113, 121

[56] References Cited

U.S. PATENT DOCUMENTS

| | | | |
|---|---|---|---|
| 3,645,319 | 2/1972 | Pondelicek et al. | 164/267 X |
| 4,738,297 | 4/1988 | Takagi et al. | 164/72 |
| 4,955,424 | 9/1990 | Takehisa et al. | 164/312 X |

FOREIGN PATENT DOCUMENTS

| | | | |
|---|---|---|---|
| 62-173062 | 7/1987 | Japan | 164/267 |
| 62-207561 | 9/1987 | Japan | 164/267 |
| 3-128160 | 5/1991 | Japan | 164/72 |
| 4-138861 | 5/1992 | Japan | 164/72 |
| 1049178 | 10/1983 | U.S.S.R. | 164/267 |

*Primary Examiner*—J. Reed Batten, Jr.

*Attorney, Agent, or Firm*—Wegner, Cantor, Mueller & Player

[57] ABSTRACT

A nozzle for spraying the mold release agent and a holding body for holding the nozzle are included in the spray device. The holding body is so constructed as to fit in an opening of a mold casting device in which a tip end of a sleeve of a feeder fits in order to feed molten metal, and the nozzle is so held by the holding body that its tip end can be extended from the holding body for a desired length and can be turned in a desired direction.

4 Claims, 7 Drawing Sheets

DEVICE FOR SPRAYING MOLD RELEASE AGENT AND FEEDING MOLTEN METAL

BACKGROUND ART

1. Industrial Useful Field

This invention relates to a spray device in which a mold release agent can be sprayed onto inside surfaces of a metal mold for a mold casting device under its closed state.

2. Prior Art

FIG. 13 is a schematic vertical sectional view showing spraying by using a conventional spray device in a vertical-type mold casting device. FIG. 14 is a schematic vertical sectional view showing spraying work by using a conventional spray device in a vertical/horizontal-type mold casting device. In the figures, 1 denotes a metal mold which is in an opened state. 2 denotes a feeder which is composed of a sleeve 21 and a piston 22. 3 denotes a nozzle of the spray device. The sleeve 21 is so designed in FIG. 13 as to fit in a lower opening 11*a* of a passage 11 connecting to an inside space of the metal mold 1, and so designed in FIG. 14 as to fit in a lower opening 11*b* which is created when the metal mold 1 is closed.

In the conventional spray device, as shown in the figures, the metal mold 1 has been opened, and under this state the mold release agent has been sprayed onto the inside surfaces of the mold 1 by putting the nozzle 3 in the opened metal mold 1.

Problem to be Solved by the Invention

It has been required to spray the mold release agent under the opened state of the metal mold 1 in the conventional spray device, so that there has been the following problems of worsening a work environment.

(1) The mold release agent has dispersed around to pollute surroundings.

(2) Noise has been conspicuous due to sound emitted at time of spraying.

Object of the Invention

An object of the invention is to provide a spray device which is able to prevent worsening of work environment and to improve workability.

SUMMARY OF THE INVENTION

This invention provides a spray device comprising a nozzle for spraying a mold release agent and a holding body for holding the nozzle, wherein the holding body is so constructed as to fit in an opening of a mold casting device in which a tip end of a sleeve of a feeder fits in order to feed molten metal, and the nozzle is so held by the holding body that its tip end can be extended from the holding body for a desired length and can be turned in a desired direction.

In this invention, the holding body of the spray device is fit in the opening of the mold casting device to carry out spraying, and the holding body is pulled away from the opening and the tip end of the sleeve is fit in the opening in its place to carry out a molten metal feeding work.

DETAILED DESCRIPTION OF THE INVENTION

Figure 1:
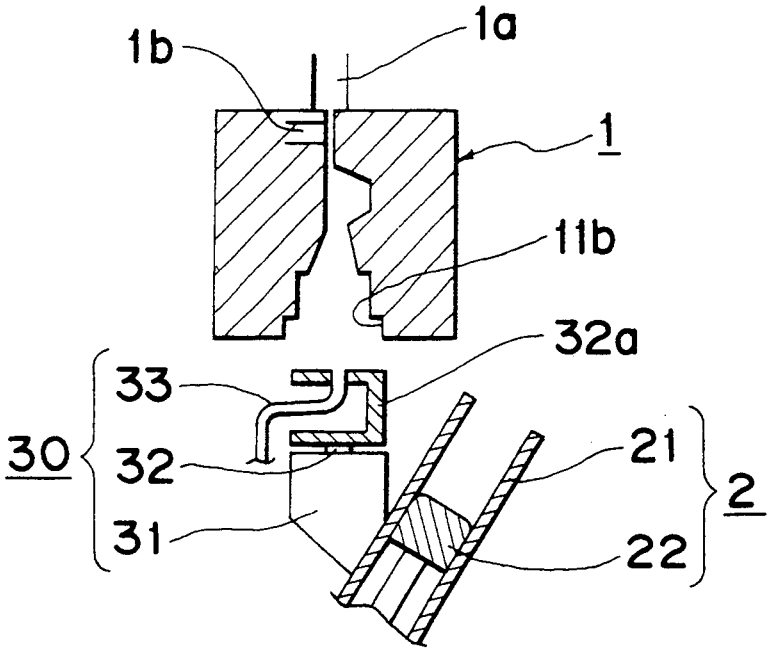
FIG. 1 through FIG. 8 are schematic vertical sectional views showing each process of mold casting work using a spray device of this invention, respectively.

An embodiment of this invention will be described hereunder with reference to the drawings.

FIG. 1 through FIG. 8 are schematic vertical sectional views showing mold casting work using the spray device of this invention, in order of process. 1 denotes a metal mold of a vertical/horizontal-type mold casting device which is in a closed state. 1*a* denotes a suction pipe and 1*b* denotes a plug. 2 denotes a feeder and 30 denotes a spray device. The feeder 2 is composed of a sleeve 21 and a piston 22. The spray device 30 is equipped with a cylinder 31, a rod 32 and a nozzle 33. The nozzle 33 is held by a tip end portion 32*a* of the rod 32.

Figure 5:
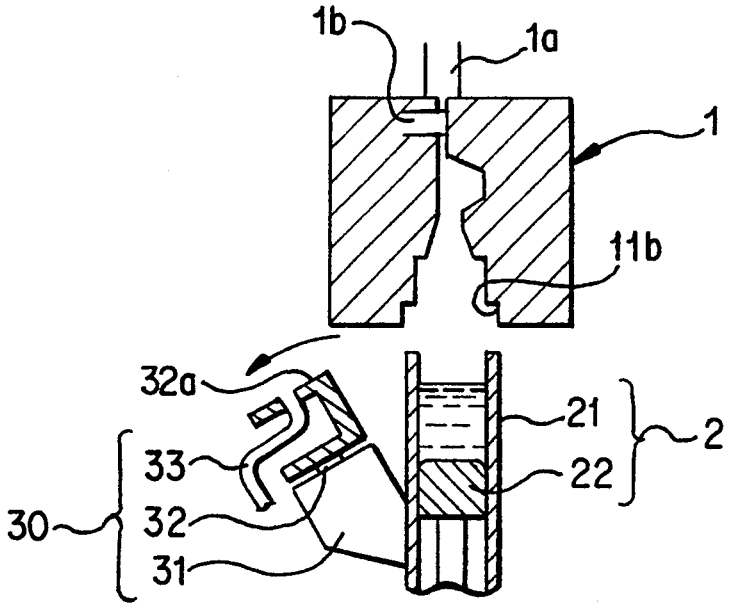

An opening 11*b*, which connects to an inside space under the closed state, is made on a lower surface of the metal mold 1. The sleeve 21 is so formed that its upper end portion fits in the opening 11*b* from under side, and the tip end portion 32*a* is so formed that its upper end portion fits in the opening 11*b* from under side in the same way. The spray device 30 is so designed that the tip end portion 32*a* is located just under the opening 11*b* when the spray device is raised up from its inclined position as shown by FIG. 1, and the feeder 2 is so designed that the upper end portion of the sleeve 21 is located just under the opening 11*b* when the feeder is raised up from its inclined position as shown by FIG. 5. The spray device 30 and the feeder 2 are so designed that they can not be raised up simultaneously.

Figure 9:
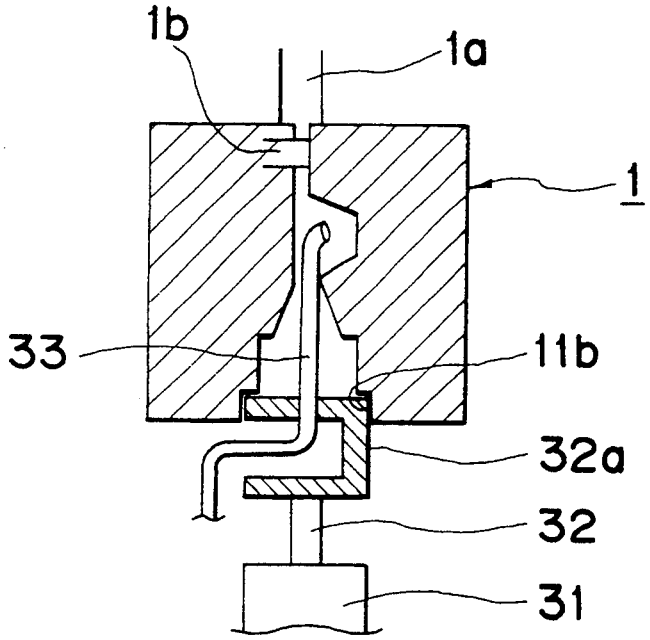
FIG. 9 is a schematic vertical sectional view showing one spraying state of FIG. 3.

The nozzle 33 is so held by the tip end portion 32*a* that its tip end can be extended from the tip end portion 32*a* for a length and can be turned in a desired direction, as shown by FIG. 9.

A casting work using the spray device 30 having the construction as described above will be explained hereunder in order of process.

Figure 2:
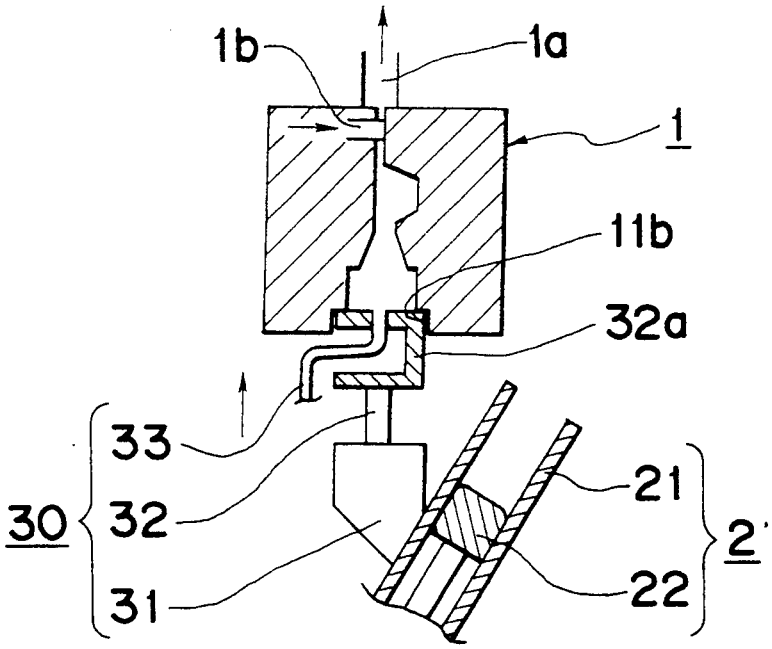
Figure 3:
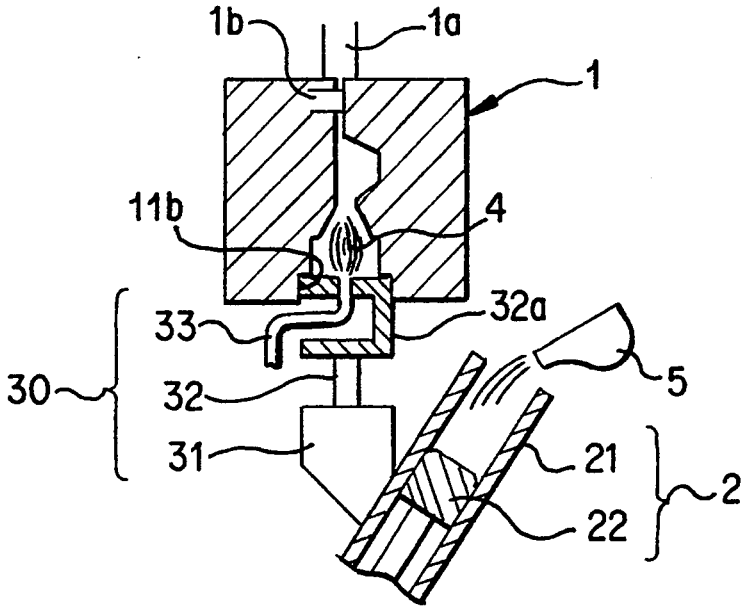

In the first place, the metal mold 1 is closed and the tip end portion 32*a* of the spray device 30 is located just under the opening 11*b*, as shown by FIG. 1. In this instance, the feeder 2 is inclined. In the second place, the rod 32 of the spray device 30 is extended upward, the tip end portion 32*a* is fit in the opening 11*b*, vacuum suction is applied from the suction pipe 1*a*, and the plug 1*b* is closed, as shown by FIG. 2. In the third place, a mold release agent 4 is sprayed from the nozzle 33 onto wall surfaces of inside space of the metal mold 1, as shown by FIG. 3. Powdery or granular agent is used for the mold release agent 4, in this instance. In parallel with the spraying of the mold release agent 4, molten metal is filled from a feeding container 5 into the sleeve 21. The spraying of the mold release agent 4 is carried out uniformly onto the entire wall surfaces of inside space of the metal mold 1 by extending a tip end of the nozzle 33 from the tip end portion 32*a* for a voluntary length and by turning it in a desired direction, as shown by FIG. 9.

Figure 4:
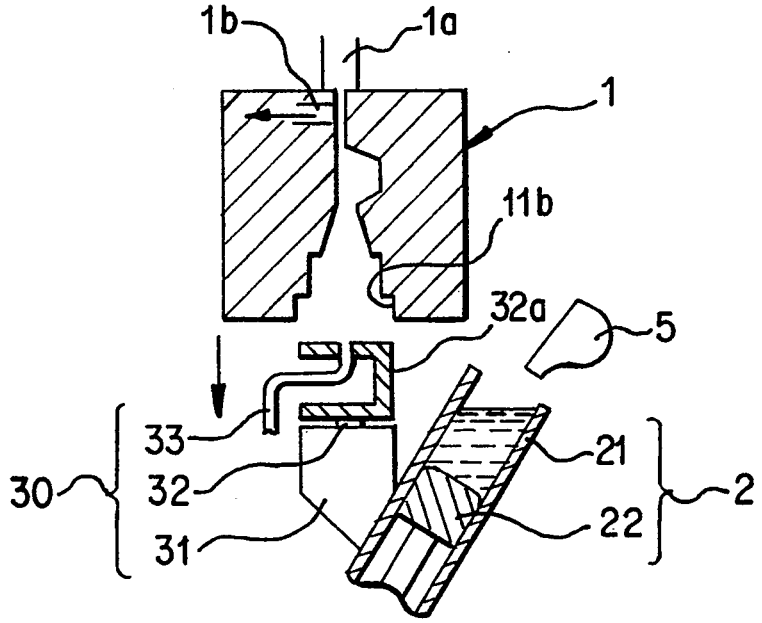
Figure 6:
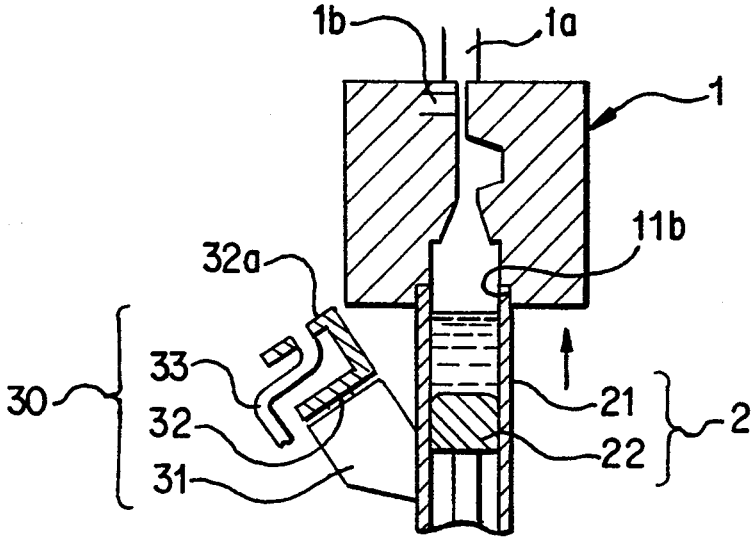
Figure 7:
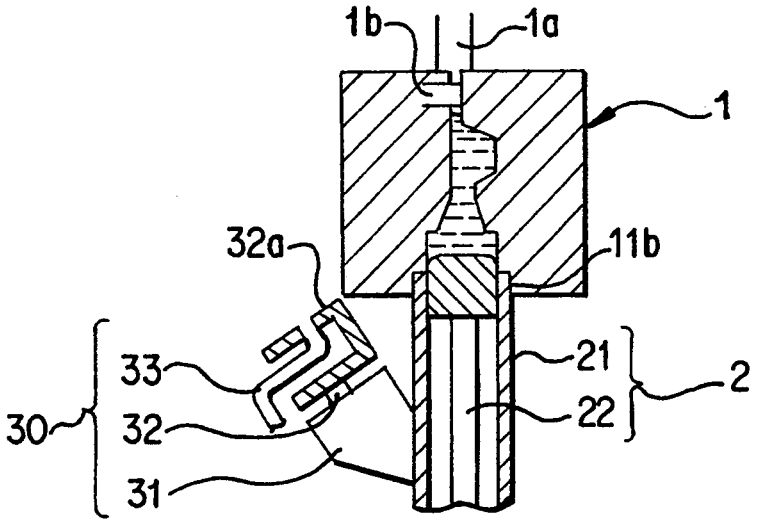
Figure 8:
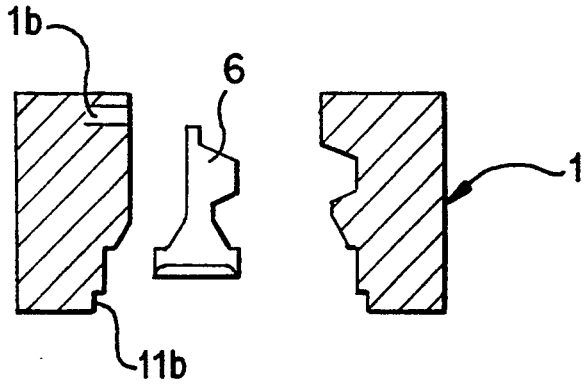

In the fourth place, as shown by FIG. 4, the rod 32 is moved downward and the tip end portion 32*a* is pulled away from the opening 11*b*, so that the plug lb is opened. In the fifth place, as shown by FIG. 5, the spray device 30 is inclined so as to raise up the feeder 2, and an upper end portion of the sleeve 21 is located just under the opening 11*b*. In the sixth place, the feeder 2 is moved upward so as to fit the tip end portion of the sleeve 21 in the opening 11*b*, as shown by FIG. 6. In the seventh place, the piston 22 is moved and molten metal in the sleeve 21 is filled in the inside space of the metal mold 1, as shown by FIG. 7. Then, after a specified time has elapsed, the sleeve 21 is pulled away from the opening 11*b*, and the metal mold 1 is opened to take out a cast product 6.

As described above, the spray work of the mold release agent 4 by using the spray device 30 is carried out under the state where the metal mold 1 is closed. Accordingly, there in no possibility of polluting the environment due to dispersion of the mold release agent. Further, there is little chance for sound produced at time of spraying to leak outside, so that the worsening of environment due to pollution and noise can he prevented.

Furthermore, shifting from spraying to the feeding work is done by only inclining the spray device 30 so as to raise up the feeder 2 under the state where the metal mold 1 is kept closed. In addition, the molten metal is filled in the feeder 2 during spraying. Consequently, the workability is improved by a large margin.

Since the nozzle 33 is held by the tip end portion 32*a* in such the manner that the tip end of the nozzle can be extended from the tip end portion 32*a* for a desired length and can be turned in a desired direction, the mold release agent 4 is sprayed uniformly onto the entire wall surfaces of inside space of the metal mold 1 when the nozzle 33 is used as shown in FIG. 9. Therefore, seizure does not occur on the cast product 6 and the cast product 6 can be taken out from the metal mold 1 successfully, The powdery or granular agent is used for the mold release agent 4, so that water is not necessary. For this reason, it is not necessary to treat waste water so that environmental pollution due to waste water can be prevented and the work can be simplified.

ANOTHER EMBODIMENT

Figure 10:
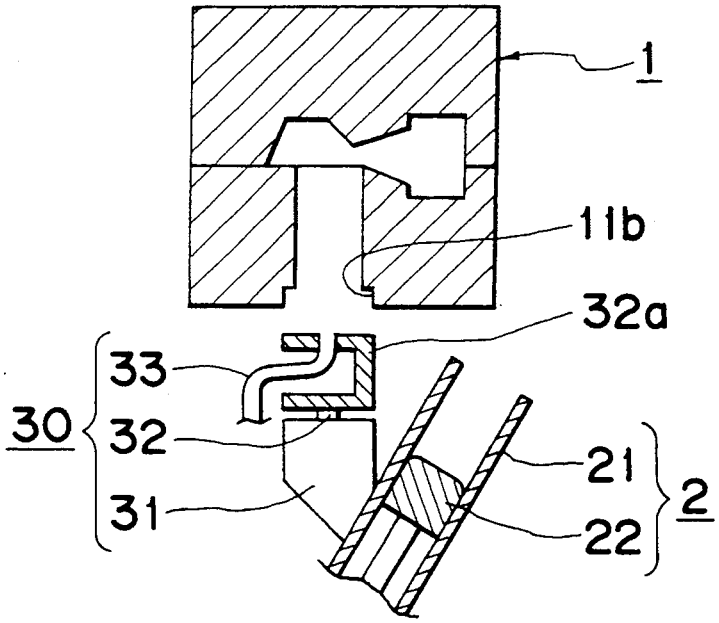
FIG. 10 through FIG. 12 are schematic vertical sectional views showing each process of mold casting work of another embodiment using a spray device of this invention, respectively.
Figure 11:
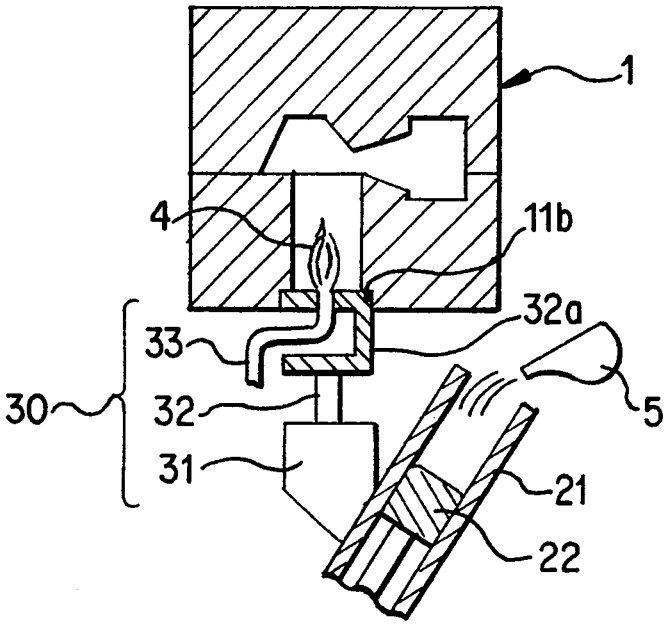
Figure 12:
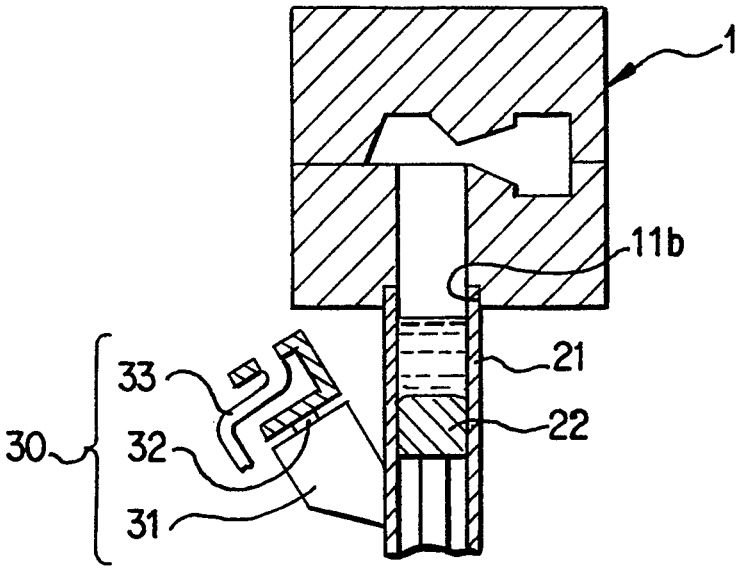
Figure 13:
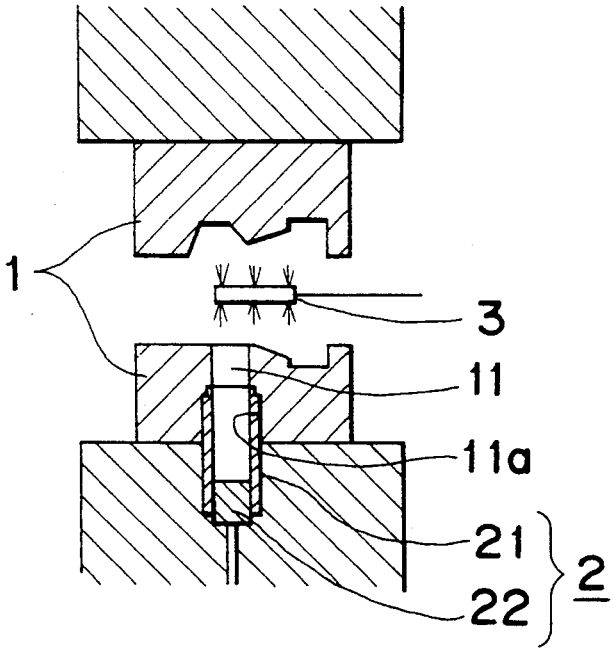
Fig. 13 Prior Art
FIG. 13 is a schematic vertical sectional view showing spraying by using a conventional spray device in a vertical-type mold casting device.
Figure 14:
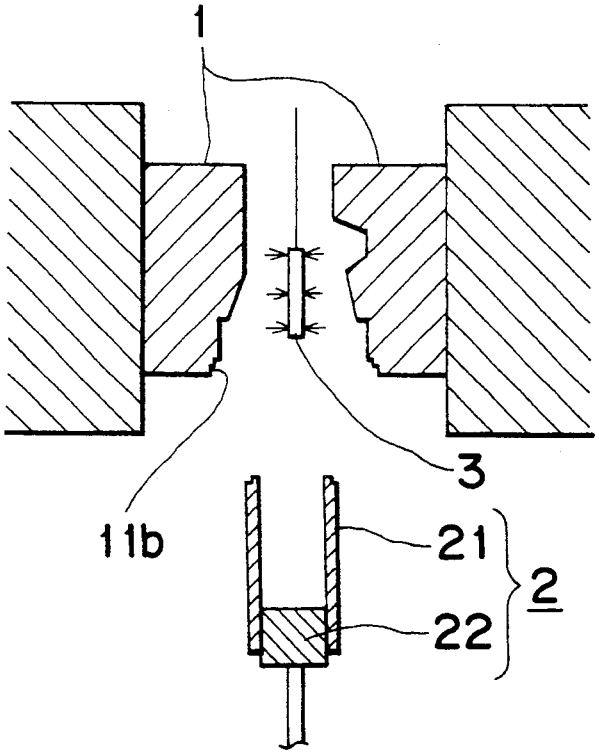
Fig. 14 Prior Art
FIG. 14 is a vertical sectional view showing spraying using a conventional spray device in a vertical/horizontal-type mold casting device.

The spray device 30 may be applied to a vertical-type mold casting device, and the casting work is carried out in the same way as described above. Namely, the tip end portion 32*a* of the spray device 30 is located just under the opening 11*b* of the closed metal mold 1 as shown by FIG. 10 The tip end portion 32*a* is fit in the opening 11*b*, the mold release agent 4 is sprayed from the nozzle 33 onto the wall surfaces of inside space of the metal mold 1, and the molten metal is filled from the feeding container 5 into the sleeve 21, as shown by FIG. 11. Then, the spray device 30 is inclined so as to raise up the feeder 2, the upper end portion of the sleeve 21 is fit in the opening 11*b*, and the molten metal in the sleeve 21 is filled in the inside space of the metal mold 1.

EFFECT OF THE INVENTION

As described above, the spray device 30 of this invention includes the nozzle 33 for spraying the mold release agent 4 and the tip end portion 32*a* of the rod 32 for holding the nozzle 33 wherein the tip end portion 32*a* is so constructed as to fit in the opening 11*b* of the mold casting device in which the upper end portion of the sleeve 21 of the feeder 2 fits in order to feed the molten metal, and the nozzle 33 is so held by the tip end portion 32*a* that its tip end can be extended from the tip end portion 32*a* for a desired length and can be turned in a voluntary direction. Therefore, the following effects can be obtained.

(1) The spray work of the mold release agent 4 by using the spray device 30 can be carried out under the state where the metal mold 1 is closed. Accordingly, there in no possibility of polluting the environment due to dispersion of the mold release agent. Further, there is little chance for sound produced at time of spraying to leak outside, so that the worsening of environment due to pollution and noise can be prevented.

(2) The mold release agent 4 can be sprayed uniformly onto the entire wall surfaces of inside space of the metal mold 1 by extending the tip end of the nozzle 33 from the tip end portion 32*a* for a desired length and by turning it in a desired direction. Therefore, the seizure of the cast product 6 can be prevented and the cast product 6 can be taken out from the metal mold 1 successfully.

(3) The spray device 30 is so designed that the tip end portion 32*a* is located just under the opening 11*b* when the spray device is raised up from its inclined position, the feeder 2 is so designed that the upper end portion of the sleeve 21 is located just under the opening 11*b* when the feeder is raised up from its inclined position, and the both devices are so designed that they can not be raised up simultaneously. Thereby, the shifting from spraying to the feeding work can be done by only inclining the spray device 30 and raising up the feeder 2 under the state where the metal mold 1 is kept closed. In addition, the molten metal can be filled in the feeder 2 during the spray work. Consequently, the workability is improved by a large margin.

What is claimed is:

1. A device for spraying a mold-release agent onto inside surfaces of a metal mold of a mold casting device and for feeding molten metal into the mold comprising (a) a nozzle for spraying the mold release agent, (b) a holding body carrying the nozzle, and (c) a feeder having a sleeve for feeding molten metal into the mold, wherein the holding body and the sleeve can alternatively extend to and fit in an opening of the mold casting device, and wherein the nozzle is extendible from the holding body to a desired length and turnable in a desired direction.

2. The device of claim 1 wherein the sleeve, which is extendible from the feeder, and the holding body are extendible in an alternating manner, and wherein the sleeve and the holding body are not extendible simultaneously.

3. In a mold casting device comprising a metal mold having inside surfaces, a nozzle for spraying a mold-release agent onto the inside surfaces of the metal mold, and a feeder for feeding molten metal into the old, the improvement wherein the device further comprises (a) a holding body carrying the nozzle in an extendible and turnable manner and (b) a sleeve carried by the feeder, wherein the holding body and the sleeve alternatively extend to and fit in an opening of the device in order to deliver the mold-release agent and molten metal to the mold.

4. The device of claim 3 wherein the sleeve, which is extendible from the feeder, and the holding body are extendible in an alternating, but not simultaneous, manner.

* * * * *